US009395136B1

(12) United States Patent
Kovalov

(10) Patent No.: US 9,395,136 B1
(45) Date of Patent: Jul. 19, 2016

(54) FLEXIBLE MONOCORE BAFFLE APPARATUS AND RELATED METHODS

(71) Applicant: KD&E Dynamics, Manchester, NH (US)

(72) Inventor: Paul Kovalov, Manchester, NH (US)

(73) Assignee: KD&E Dynamics, Manchester, NH (US)

( * ) Notice: Subject to any disclaimer, the term of this patent is extended or adjusted under 35 U.S.C. 154(b) by 0 days.

(21) Appl. No.: 14/598,746

(22) Filed: Jan. 16, 2015

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30
USPC ..... 89/14.4; 181/223
See application file for complete search history.

(56) References Cited

U.S. PATENT DOCUMENTS

| | | | | |
|---|---|---|---|---|
| 1,021,742 | A | 3/1912 | Moore | |
| 1,213,558 | A | 1/1917 | Turner | |
| 1,991,748 | A | 2/1935 | Johnson | |
| 2,065,343 | A | 12/1936 | Moore et al. | |
| 3,748,956 | A | 7/1973 | Hubner | |
| 4,325,459 | A | 4/1982 | Martin | |
| 4,584,924 | A | 4/1986 | Taguchi | |
| 4,974,489 | A * | 12/1990 | Fishbaugh | 89/14.4 |
| 5,183,976 | A | 2/1993 | Plemons, Jr. | |
| 7,044,266 | B2 | 5/2006 | Petracek | |
| 7,549,511 | B2 | 6/2009 | Marocco | |
| 8,424,635 | B1 * | 4/2013 | Klawunn | 181/223 |
| 8,528,691 | B1 * | 9/2013 | Carmichael et al. | 181/223 |
| 8,640,821 | B2 | 2/2014 | Matsushima et al. | |
| 9,038,770 | B1 * | 5/2015 | Morrison | 181/223 |
| 9,046,316 | B1 * | 6/2015 | Young | |
| 9,086,248 | B2 * | 7/2015 | Young et al. | |
| 9,115,950 | B2 * | 8/2015 | Bethlenfalvy | |
| 2005/0103567 | A1 | 5/2005 | Petracek | |
| 2008/0035418 | A1 | 2/2008 | Marocco | |
| 2009/0101434 | A1 | 4/2009 | Sammut et al. | |
| 2014/0190345 | A1 | 7/2014 | Daniel et al. | |
| 2014/0262604 | A1 | 9/2014 | Proske | |
| 2014/0374189 | A1 * | 12/2014 | Young et al. | 181/223 |

* cited by examiner

*Primary Examiner* — Forrest M Phillips
(74) *Attorney, Agent, or Firm* — Hayes Soloway PC

(57) ABSTRACT

A monocore baffle apparatus and related methods is disclosed. The monocore baffle apparatus includes a monocore frame having an interior section, wherein the interior section is positioned between a first end and a second end of the monocore frame. A shell is positioned about an exterior of the monocore frame. A plurality of tabs is connected to the monocore frame and extends into the interior section, wherein at least a portion of the plurality of tabs is flexibly connected to the monocore frame.

27 Claims, 24 Drawing Sheets

FLEXIBLE MONOCORE BAFFLE APPARATUS AND RELATED METHODS

FIELD OF THE DISCLOSURE

The present disclosure is generally related to baffle devices and more particularly is related to a flexible monocore baffle apparatus and related methods.

BACKGROUND OF THE DISCLOSURE

Baffle devices exist in various forms to decrease noise and gas flow from mechanical devices prior to the noise or gas being emitted into the atmosphere. Baffle devices are common in a variety of industries, including the firearms industry, the automotive industry, the energy industry, and many others. For example, baffle devices may be used with automobiles within automotive mufflers to decrease the noise produced by the automobile's engine. Baffle devices are also commonly used within sound suppressors on firearms to decrease the noise when the firearm is discharged. Sound suppression devices used with firearms are commonly referred to as silencers or suppressors.

While the construction and design of a baffle device may vary, depending on its use, all baffle devices generally include an enclosed pathway receiving the gas discharged from the automobile, firearm, or other machine. Within the enclosed pathway, the discharged gas contacts the baffles which disrupt the movement of the discharged gas, thereby providing resistance or redirection to the discharged exhaust gas flow. If the gas flow is redirected gradually, laminar flow of gas can be maintained while still decreasing temperature and pressure of the gas and lowering the sound pressure level of the discharge. Otherwise, this resistance causes the discharged gas to become turbulent and drop in pressure across the enclosed pathway, thereby decelerating the velocity of the discharged gas. As the discharged gas decelerates, being trapped between the baffles within the enclosed pathway, it loses energy and eventually exits the enclosed pathway. The ability of the baffle device to decelerate the gas acts to extend the period of time in which the discharged gas exits into the atmosphere and the amount of time the gas has to transfer heat to the surroundings, as compared to the discharged gas exiting directly into the atmosphere without obstruction, which reduces the noise created by the discharged gas.

While conventional baffle devices have many successes, they are often expensive and time consuming to manufacture and assemble, either consisting of multiple small parts or of a single monocore that requires extensive machining. Such baffle devices also require a secondary shell enclosure to act as a gas pathway and pressure vessel. Furthermore, the rigid nature of most baffle systems makes them difficult to remove and service once particulate debris and fouling from exhaust gases is deposited between the shell and the baffles of the device.

Thus, a heretofore unaddressed need exists in the industry to address the aforementioned deficiencies and inadequacies.

SUMMARY OF THE DISCLOSURE

Embodiments of the present disclosure provide a system and method for a monocore baffle apparatus. Briefly described, in architecture, one embodiment of the system, among others, can be implemented as follows. A monocore baffle apparatus has a monocore frame having an interior section, wherein the interior section is positioned between a first end and a second end of the monocore frame. A shell is positioned about an exterior of the monocore frame. A plurality of tabs is connected to the monocore frame and extending into the interior section, wherein at least a portion of the plurality of tabs is flexibly connected to the monocore frame.

The present disclosure can also be viewed as providing a monocore baffle apparatus. Briefly described, in architecture, one embodiment of the apparatus, among others, can be implemented as follows. A monocore baffle apparatus has a monocore frame having an interior section, wherein the interior section is positioned between a first end and a second end of the monocore frame, wherein a central axis of the monocore frame is positioned parallel with a length of the monocore frame. A shell is positioned about an exterior of the monocore frame. A plurality of tabs are connected to the monocore frame and extend into the interior section, wherein at least a portion of the plurality of tabs is flexibly connected to the monocore frame, wherein a first group of tabs of the plurality of tabs is positioned non-axially-opposing a second group of tabs of the plurality of tabs about the central axis of the monocore frame, and wherein each tab of the plurality of tabs further comprises a curvilinear shape.

The present disclosure can also be viewed as providing methods of manufacturing a monocore baffle. In this regard, one embodiment of such a method, among others, can be broadly summarized by the following steps: cutting a substantially planar sheet of material, whereby a plurality of tabs are formed within a first portion of the substantially planar sheet of material, wherein a second portion of the substantially planar sheet of material has no tabs formed therein; rolling the first portion of the substantially planar sheet of material about an axis thereby forming a rolled first portion; bending the plurality of tabs towards the axis, thereby extending the plurality of tabs into an interior section of the rolled first portion of the substantially planar sheet of material; and rolling the second portion of the substantially planar sheet of material about an exterior of the rolled first portion.

The present disclosure can also be viewed as providing methods for muffling sound using a monocore baffle device. In this regard, one embodiment of such a method, among others, can be broadly summarized by the following steps: providing a monocore frame having an interior section, wherein the interior section is positioned between a first end and a second end of the monocore frame, wherein a shell is positioned about an exterior of the monocore frame, and wherein a plurality of tabs is flexibly connected to the monocore frame and extends into the interior section; forcing a quantity of gas through the monocore frame from the first end to the second end, whereby the quantity of gas contacts the plurality of tabs; and flexing the plurality of tabs towards a central axis of the monocore frame upon contact with the quantity of gas.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
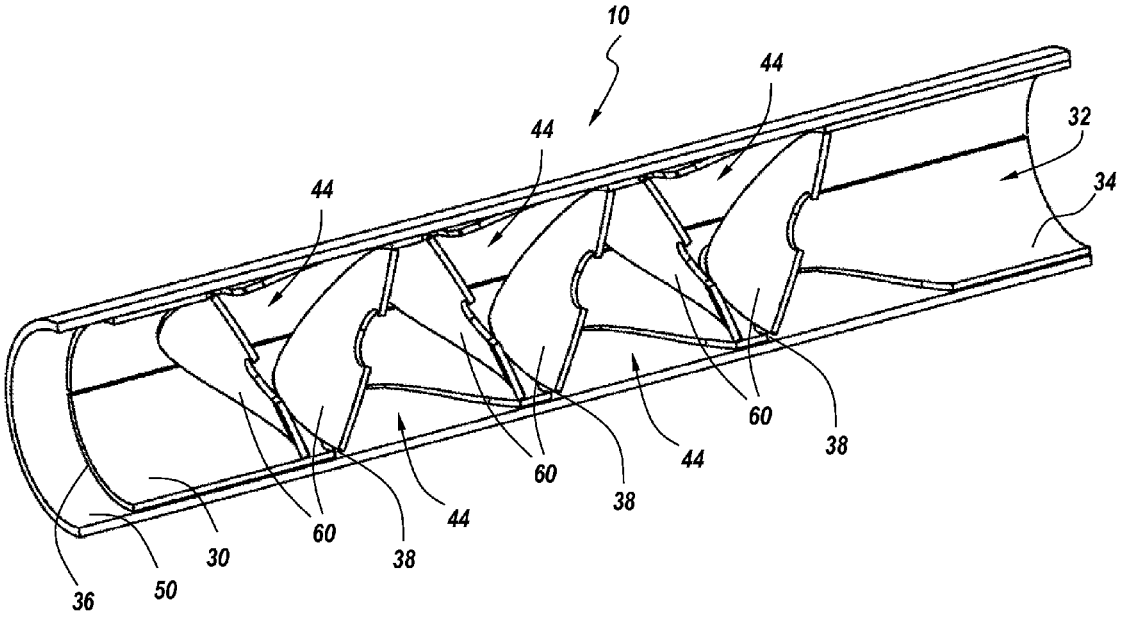
FIG. 1 is a cross-sectional illustration of a monocore baffle apparatus, in accordance with a first exemplary embodiment of the present disclosure.

FIG. 1 is a cross-sectional illustration of a monocore baffle apparatus 10, in accordance with a first exemplary embodiment of the present disclosure. The monocore baffle apparatus 10, which may be referred to herein simply as 'apparatus 10' may be used to reduce noise created during the discharge of gas from a device, such as a firearm, an automobile, or another device having an exhaust discharge. The apparatus includes a monocore frame 30 having an interior section 32, wherein the interior section 32 is positioned between a first end 34 and a second end 36 of the monocore frame 30. A shell 50 is positioned about an exterior of the monocore frame 30. A plurality of tabs 60 is connected to the monocore frame 30 and extends into the interior section 32, wherein at least a portion of the plurality of tabs 60 is flexibly connected to the monocore frame 30.

The monocore frame 30 is a substantially rigid and durable structure which, with the plurality of tabs 60, forms a monocore. The term 'monocore' as used herein refers to a singular unitary component which forms all or part of a baffle device. For instance, the monocore of the present disclosure includes the monocore frame 30 with the plurality of tabs 60 extending therefrom, which together, form a singular unitary structure of the apparatus 10. In contrast, many suppressor devices may be constructed from a single housing which receives a plurality of individual distinct baffles, whereby when the numerous baffles are oriented together within the housing, a multi-component baffle device is formed. The monocore frame 30 is formed from a metal or metallic alloy as a substantially cylindrical structure having a length, as measured between the first and second ends 34, 36, which substantially exceeds a width or diameter of the monocore frame 30. The frame 30 may have the ability to flex in some directions, although it may be substantially rigid along its length. The interior section 32 may comprise all or part of the spatial area positioned interior of the wall of the monocore frame 30. While a cylindrical shape of the monocore frame 30 may be preferable, the monocore frame 30 may also have other shapes, such as hexagonal, octagonal, or other shapes.

The shell 50 is positioned about the exterior of the monocore frame 30, such that it is located surrounding the monocore frame 30. Depending on the design of the apparatus 10, the shell 50 may be positioned in abutment with an exterior surface of the monocore frame 30, as is shown in FIG. 1, or it may be positioned a spaced distance from the exterior surface of the monocore frame 30. The shell 50 may be formed from a substantially rigid, durable material, such as a fiber reinforced resin, polymer, metal, or metallic alloy, the same or different from the materials of the monocore frame 30. Any portion of the shell 50 may have a surface treatment, such as paint, or other features commonly included with conventional baffle devices, such as fasteners or connectors for connecting the apparatus 10 to a machine with which the apparatus is to be used.

A plurality of tabs 60 may include any number of tabs 60, the specific quantity of tabs 60 being dependent on the use of the apparatus 10, the length of the monocore frame 30, or other aspects of the apparatus 10. Each of the tabs 60 is connected to the monocore frame 30 at a connection joint 38, which is described in detail relative to FIG. 5. Each of the tabs 60 extend into the interior section 32 of the monocore frame 30, where they are positioned to obstruct a gas flow through the monocore frame 30. The plurality of tabs 60, or at least a portion thereof, are flexibly connected to the monocore frame 30 at the connection joint 38, such that the tabs 60 can be flexed or moved when contacted by the gas discharged through the monocore frame 30. The ability of the tabs 60 to be flexibly connected to the monocore frame 30 provides significant benefits in disrupting the gas flow through the apparatus 10 to a higher degree than conventional devices can achieve, since the flexing of the tabs 60 upon contact with the discharged gas can absorb a greater amount of kinetic energy than baffles that are not flexibly connected to their support structure, like a spring that absorbs energy when acted on by a force. The ability of the tabs 60 to be flexibly connected to the monocore frame 30 also provides significant benefits in disrupting resonant standing waves within the apparatus 10, since the flexing of the tabs 60 upon contact with the discharge gas can alter the volume of the chambers 44 formed between the tabs 60. The flexibly connected tabs 60 are detailed further relative to FIGS. 6-8B.

Figure 2:
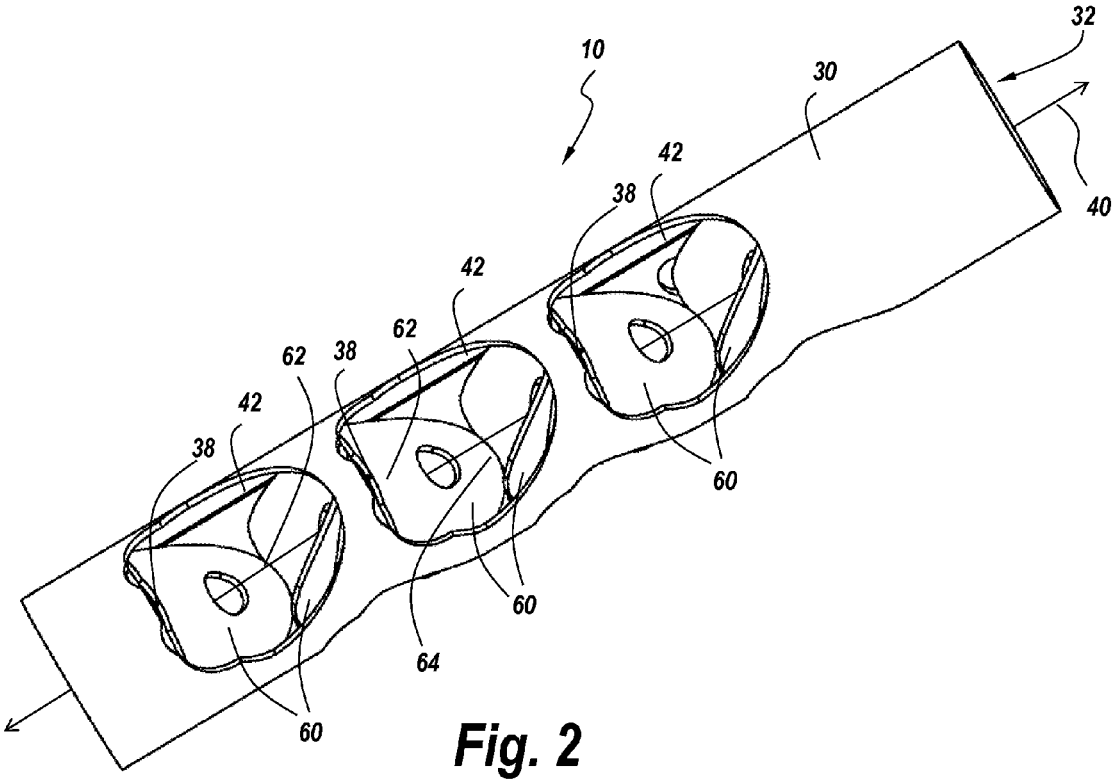
FIG. 2 is an isometric view illustration of a monocore baffle apparatus, in accordance with the first exemplary embodiment of the present disclosure.
Figure 3:
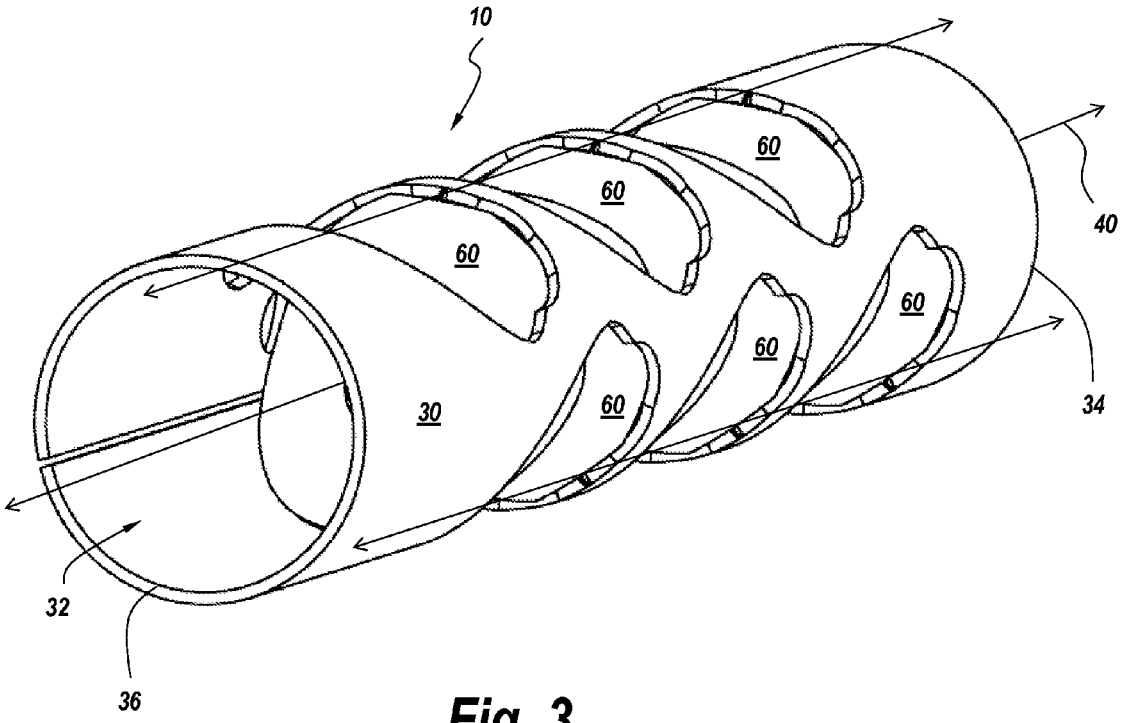
FIG. 3 is an isometric view illustration of a monocore baffle apparatus, in accordance with the first exemplary embodiment of the present disclosure.

FIG. 2 is an isometric view illustration of a monocore baffle apparatus 10, in accordance with the first exemplary embodiment of the present disclosure. FIG. 3 is an isometric view illustration of a monocore baffle apparatus 10, in accordance with the first exemplary embodiment of the present disclosure. The apparatus 10 of FIGS. 2-3 is depicted without the shell 50 (FIG. 1) for clarity in disclosing the structures and features of the apparatus 10. As can be seen, each of the plurality of tabs 60 is positioned flexibly connected to the monocore frame 30 via connection joint 38, and each of the tabs 60 is positioned within the interior section 32 of the monocore frame 30. The tabs 60 may have an orientation and positioning within the interior section 32 which allows for all of the tabs 60 to fit within the interior section 32, with or without contacting one another.

The specific positioning and orientation of the tabs 60 may largely be a factor of the shape and size of the tabs 60 and/or the radial point of attachment of the tabs 60 on the monocore frame 30. The tabs 60 may have a variety of shapes and sizes, all of which are considered part of the present disclosure. In one example, the tabs 60 have a non-planar shape, such as a shape that is curved or arced. A non-planar shape may include a portion of one tab 60 or a portion of the entirety of the tabs 60 having a non-planar shape. As is shown in FIG. 2, the non-planar shape embodied as a curve or arc may include an axis of symmetry that is positioned substantially along a middle of the tab 60 and may be aligned with the connection joint 38. This shape of the tab 60 may be created during a rolling process of the monocore frame 30 (or from an initial shape of the monocore frame 30), whereby the tab 60 has a curved shape that is the same or similar to the curved shape of the monocore frame 30, e.g., the same radius of curvature. When the apparatus 10 is manufactured, the tab 60 may be cut from the sidewall of the monocore frame 30, such that a cutout 42 of the tab 60 is formed within the monocore frame 30. In another example, the tab 60 may have a non-planar shape that includes a partial cone shape, whereby the curvature or arc of the tab 60 extends in two or more directions.

Relative to the radial alignment of the tabs 60 about the monocore frame 30, a variety of relative alignments may be included with the apparatus 10. For example, the tabs 60 may be aligned on one side of the monocore frame 30, may be opposite one another about a central axis 40 of the monocore frame 30, or may be positioned in non-axial opposition about the central axis of the monocore frame 30. The central axis 40 is positioned parallel with a length of the monocore frame 30, extending from the first end 34 to the second end 36. Commonly, one tab 60 or set of tabs 60 may be extending from a first radial area of the monocore frame 30 and a second tab 60 or second set of tabs 60 may be extending from a second radial area of the monocore frame 30, wherein the first radial area is different from the second radial area. In this orientation, apparatus 10 has tabs 60 or sets of tabs 60 that are in at least two positions radially about the central axis 40 of the monocore frame 30. The tabs 60 may be positioned opposite the central axis 40 when the first and second radial areas are opposing one another, or in another example, the first radial area of the monocore frame 30 may be non-axially-opposing the second radial area of the monocore frame 30 about the central axis. In this situation, as is shown in FIG. 2, the tabs 60 are radially offset from one another, but not positioned opposite about the central axis.

All orientations of the tabs 60 are considered within the scope of the present disclosure, but the orientation of the tabs 60 in non-axially opposition may offer benefits over opposing tabs 60. When baffles are oppositely positioned from one another, their ability to obstruct gas flow by occupying a cross-sectional space of the apparatus 10 may be limited by the opposing tab 60. The tabs 60 may contact one another, thereby limiting the positioning or movement of each tab 60 individually. In some cases, it is desirable for tabs 60 to be opposing about the central axis 40 or to contact one another, as discussed relative to other figures of this disclosure, but in many cases having the tabs 60 positioned in non-axial opposition provides additional benefits. For one, non-axial opposing tabs create greater gas disruption by forcing the gas discharged through the monocore frame 30 to have a more turbulent path than with tabs 60 in opposition. The greater the turbulence, the greater the disruption of gas may be within the monocore frame 30, which allows for better dissipation of the gas' energy. Additionally, non-axially opposing tabs 60 may allow for a shorter distance between each individual tab 60 within the monocore frame 30, thus allowing for a larger quantity of tabs 60 to be placed within the same length of monocore frame 30. Non-axially opposing tabs 60 may also allow for gas flow ports to be created by the partial overlap of a first tab 60 and the cutout 42 in the monocore frame 30 of a second tab 60. For example, as is shown in FIG. 2, when the curved tabs 60 are positioned in non-axial opposition about the central axis 40, each tab 60 has a connected end 62 proximate to the connection joint 38 and a free end 64 which is located proximate to an opposing sidewall of the monocore frame 30. The free end 64 may be the same or substantially positioned near a top perimeter edge 66 of the tab 60. If the tabs 60 are positioned in axial opposition about the central axis 40, the top perimeter edge 66 of the tab 60 would not be able to locate against an opposing sidewall of the monocore frame 30, and would instead protrude through the cutout 42 in the monocore frame 30. Varying the position of a tab 60 around the perimeter of the monocore frame 30 and varying the distance between a first tab 60 and a second tab 60 may form ports of different sizes defined by a top perimeter edge of a first tab 60 and the cutout 42 in the monocore frame 30 of a second tab 60.

Figure 4:
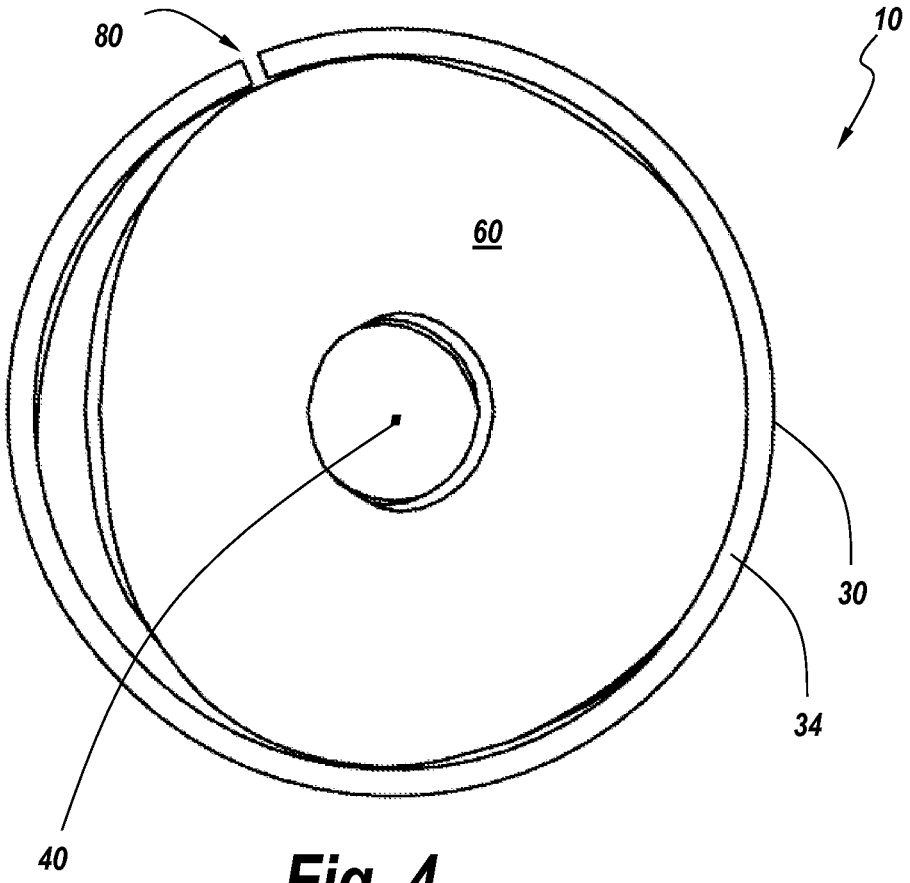
FIG. 4 is a side view illustration of a monocore baffle apparatus at the first end, in accordance with the first exemplary embodiment of the present disclosure.

FIG. 4 is a side view illustration of a monocore baffle apparatus 10 at the first end 34, in accordance with the first exemplary embodiment of the present disclosure. The apparatus 10 may further include a vein 80 positioned in a sidewall of the monocore frame 30. The vein 80 may be a gap in the monocore frame 30 which extends between the first end 34 of the monocore frame 30 and the second end (FIG. 1). The vein 80 may allow the monocore frame 30 to be flexible about the central axis 40, in that, the monocore frame 30 can have a diameter that is slightly adjustable. When the monocore frame 30 is inserted into the shell 50 (FIG. 1), the ability to slightly decrease the diameter of the monocore frame 30 may allow easier insertion of the monocore frame 30 into the shell 50, where the shell 50 may be sized slightly smaller than the monocore frame 30 in an un-flexed position about the central axis 40. Thus, the natural tendency of the monocore frame 30 to expand outwards against the shell 50 may act to retain the monocore frame 30 in a stationary position within the shell 50. Likewise, flexing the monocore frame 30 about the central axis 40 may decrease a cross-sectional diameter of the monocore frame 30 during a removal of the monocore frame 30 from the shell 50. Additionally, the vein 80 may offer benefits in providing a small outlet for quantities of high velocity discharged gas to fill subsequent baffle chambers 44 (FIG. 1), without contacting the tabs 60.

Figure 5:
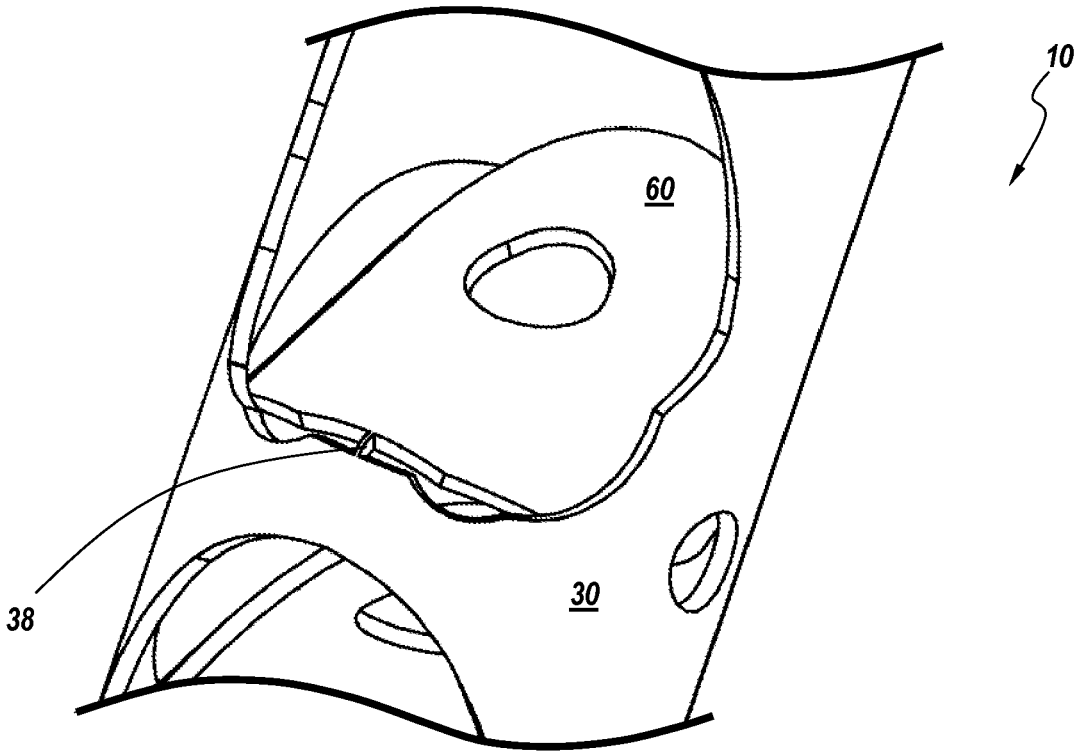
FIG. 5 is a detailed view illustration of a connection joint of a monocore baffle apparatus, in accordance with the first exemplary embodiment of the present disclosure.

FIG. 5 is a detailed view illustration of a connection joint 38 of a monocore baffle apparatus 10, in accordance with the first exemplary embodiment of the present disclosure. The connection joint 38 formed between the tab 60 and the monocore frame 30 is designed to allow the tab 60 to be flexibly connected to the monocore frame 30, such that the tab 60 can be flexed, moved, and achieve a change in position when the gas discharged through the monocore frame 30 contacts the tab 60. As is shown in FIG. 5, the connection joint 38 may include a small quantity of material that connects the tab 60 to the monocore frame 30. The material between the monocore frame 30 and the tab 60 that forms the connection joint 38 may be sized substantially smaller than a width of the tab 60 so that the material of the connection joint 38 preferentially flexes when the tab 60 is acted on by a quantity of exhaust gas, and the tab 60 remains relatively rigid. The connection joint 38 may incorporate additional features such as gussets, perforations, welds, reinforcing ribs or the like to modify the integrity and rigidity of the connection joint 38. The higher the rigidity of the connection joint 38, the higher the resonance frequency of the combined connection joint 38 and tab 60 system becomes. Higher rigidity at the connection joint 38 may also be necessary to limit the range of motion of the tab 60 for a given exhaust gas force, and to ensure that the material of the connection joint 38 flexes only within its elastic range, in order to avoid premature fatigue failure.

Figure 6:
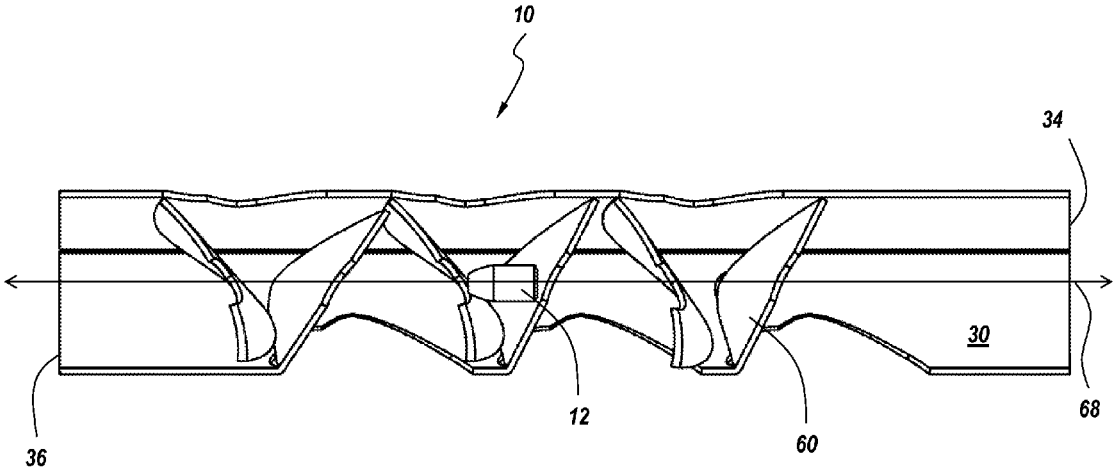
FIG. 6 is a cross-sectional view illustration of a monocore baffle apparatus with a projectile therein, in accordance with the first exemplary embodiment of the present disclosure.

FIG. 6 is a cross-sectional view illustration of a monocore baffle apparatus 10 with a projectile 12 therein, in accordance with the first exemplary embodiment of the present disclosure. The apparatus 10 may have tabs 60 that are solid or tabs 60 that have one or more openings therein. For example, when used with firearms, the apparatus 10 will include a bore through the tabs 60 which allows a projectile 12 to move through the monocore frame 30. FIG. 6 depicts the apparatus 10 with a projectile 12 positioned mid-way through the monocore frame 30, moving from the first end 34 of the monocore frame 30 to the second end 36. With reference to FIGS. 2 and 6, each of the plurality of tabs 60 of the apparatus 10 include an aperture therein, which together defines a continuous bore aperture 68 through the monocore frame 30 between the first end 34 and the second end 36 in which the projectile 12 can move. In other words, the edges of each of the apertures in the tabs 60 positioned in alignment may form the continuous bore aperture 68. In many cases, the continuous bore aperture 68 may be substantially aligned with the central axis 40 (FIG. 2), however they may also be misaligned.

Since the tabs 60 are flexibly connected to the monocore frame 30, the continuous bore aperture 68 may include a dynamically-sized aperture, in which, a cross-sectional area of the continuous bore aperture 68 formed from the cross-sectional footprint of each aperture on each tab 60 is changeable in size. The size of the dynamically-sized aperture is controlled by a flexing of the plurality of tabs 60 relative to the monocore frame 30. For example, in an un-flexed state, each tab 60 would have an aligned aperture which defines the continuous bore aperture 68, but when one or more of the tabs 60 flexes, the cross-sectional size of that tab's aperture would decrease, when calculated relative to orientation along the continuous bore aperture 68. The result is that a flexing tab decreases the overall cross-sectional size of the continuous bore aperture 68 through the monocore frame 30. Thus, the flexing of one or more tabs 60 may control the dynamic sizing of the continuous bore aperture 68.

It is noted that the continuous bore aperture 68 may be altered by decreasing its cross-sectional area, as previously discussed, in which case the continuous bore aperture 68 may change from being substantially linear in a non-flexed state of the plurality of tabs 60 to being substantially non-linear in a flexed state of the plurality of tabs 60. When a projectile 12 is fired through the continuous bore aperture 68 and the quantity of gas is forced through the monocore frame 30 from the first end 34 to the second end 36, the cross section of the continuous bore aperture 68 in the non-flexed state of the plurality of tabs 60 may be sized larger than the cross section of the continuous bore aperture 68 in the flexed state of the plurality of tabs 60. Additionally, altering the cross-sectional area of the continuous bore aperture 68 may re-position an axis of the continuous bore aperture 68 relative to the central axis 40.

Figure 7A:
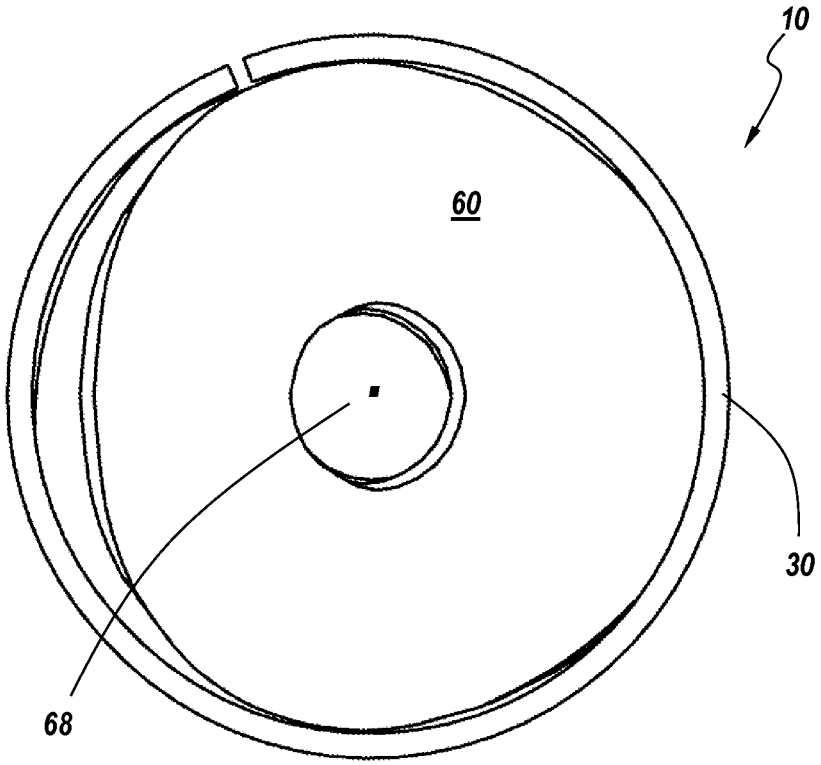
FIG. 7A is a side view illustration of a monocore baffle apparatus with the tabs in an un-flexed state, in accordance with the first exemplary embodiment of the present disclosure.
Figure 7B:
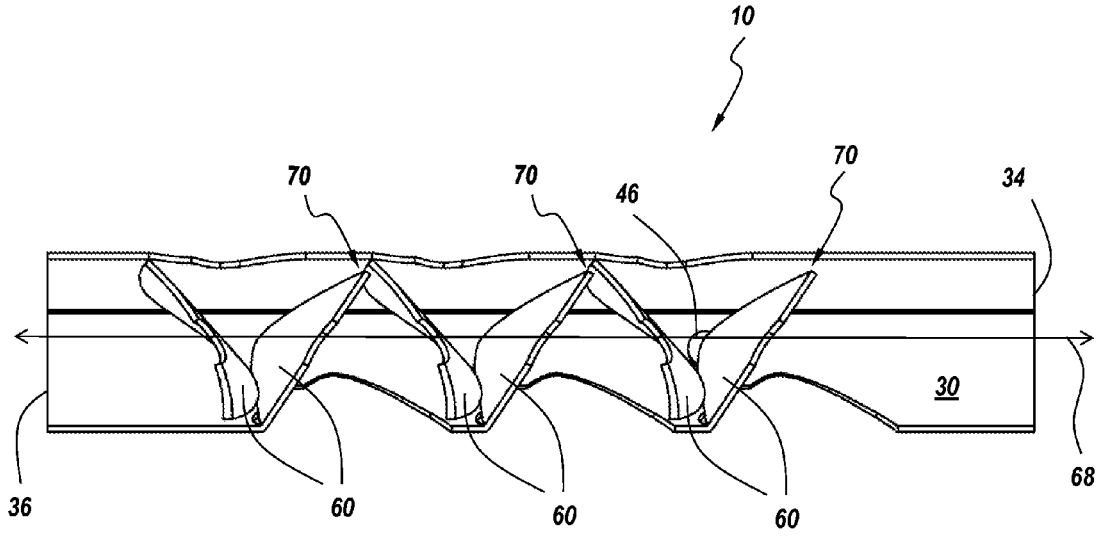
FIG. 7B is a cross-sectional view illustration of a monocore baffle apparatus with the tabs in an un-flexed state, in accordance with the first exemplary embodiment of the present disclosure.
Figure 8A:
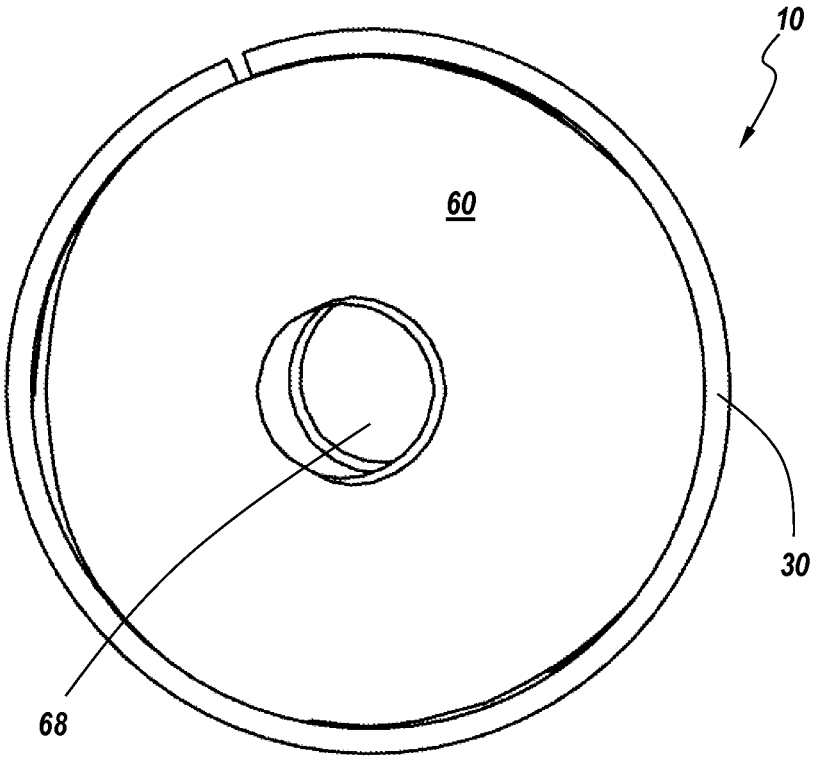
FIG. 8A is a side view illustration of a monocore baffle apparatus with the tabs in a flexed state, in accordance with the first exemplary embodiment of the present disclosure.
Figure 8B:
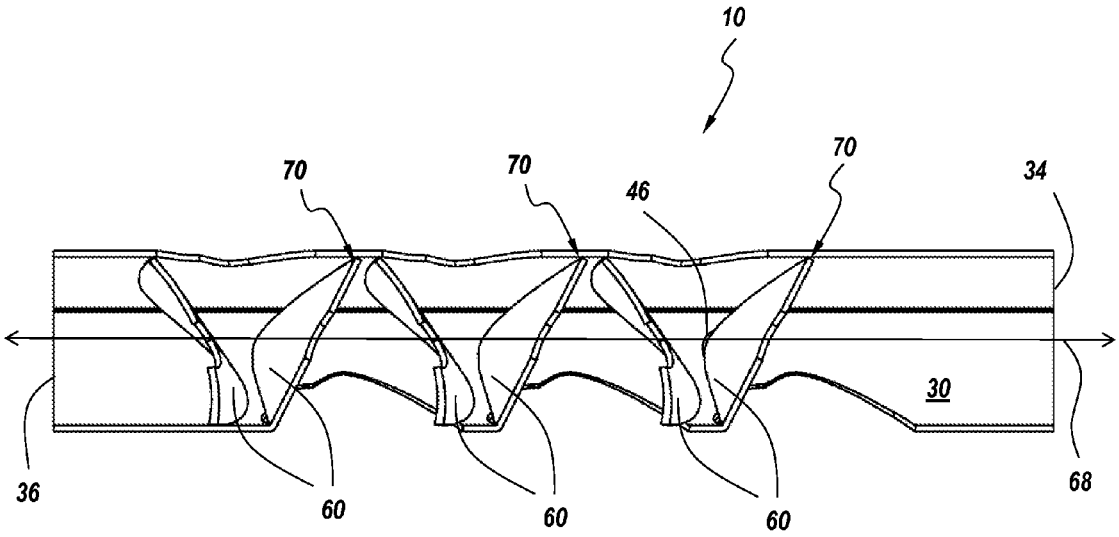
FIG. 8B is a cross-sectional view illustration of a monocore baffle apparatus with the tabs in a flexed state, in accordance with the first exemplary embodiment of the present disclosure.

FIG. 7A is a side view illustration of a monocore baffle apparatus 10 with the tabs 60 in an un-flexed state, in accordance with the first exemplary embodiment of the present disclosure. FIG. 7B is a cross-sectional view illustration of a monocore baffle apparatus 10 with the tabs 60 in an un-flexed state, in accordance with the first exemplary embodiment of the present disclosure. FIG. 8A is a side view illustration of a monocore baffle apparatus 10 with the tabs 60 in a flexed state, in accordance with the first exemplary embodiment of the present disclosure. FIG. 8B is a cross-sectional view illustration of a monocore baffle apparatus 10 with the tabs 60 in a flexed state, in accordance with the first exemplary embodiment of the present disclosure.

Flexing of the plurality of tabs 60 relative to the monocore frame 30 may be controlled by the gas moving through the monocore frame 30 and contacting the plurality of tabs 60. When gas is discharged through the monocore frame 30, the gas will contact the tabs 60 and flex them relative to the monocore frame 30. Relative to FIGS. 6-8A, tabs 60 in an un-flexed state shown in FIG. 7A, depict the continuous bore aperture 68 as having a larger cross-sectional footprint than the continuous bore aperture 68 in FIG. 8A, where the tabs 60 are in a flexed state. In use with a firearm, the un-flexed state of FIG. 7A may be prior to the projectile 12 moving through the continuous bore aperture 68, whereas the flexed state of FIG. 8A may be after the projectile 12 has moved through the continuous bore aperture 68 and the discharged gas that follows the projectile 12 has contacted the tabs 60. Similarly, In FIG. 7B, the tabs 60 are depicted as having ports 70, positioned between the tab 60 and the inner sidewall of the monocore frame 30, being substantially open in the un-flexed state, whereas in FIG. 8B, the ports 70 are substantially closed.

Flexing of the tabs 60 may change the size of the continuous bore aperture 68, as previously discussed, but it may also affect other properties of the apparatus 10. For example, flexing the tabs 60 can result in a change of size of the port 70 formed between the edge of the tab 60 and the inner sidewall of the monocore frame 30 and/or by the overlap of a first tab 60 with the cutout section 42 of a second tab 60, and/or by the overlap of the tab 60 with a secondary cutout section 46 in the monocore frame 30, which in turn, can affect the volume and velocity of gas that is moved through the port 70. The port 70 with the first tab 60 in an un-flexed state is a different size than the port 70 with the first tab 60 in a flexed state. When discharged gas contacts the tab 60, it will place a force upon the tab 60 which will act to change the size of the port 70, such as by decreasing its size or closing it fully. Decreasing the size of the port 70 will result in a smaller gap in which the discharged gas can flow. When the gap for gas flow through the port 70 is decreased, the volume of gas that can move through the port 70 will decrease and the velocity with which the gas moves through the port 70 will increase, as compared to an un-flexed tab 60 having a relatively larger port 70. As the path in which the gas can move through the apparatus 10 is made more complex, the greater the turbulence the gas will experience within the apparatus 10.

In addition to port 70 sizes changing, flexing the plurality of tabs 60 may change a volume of a baffle chamber positioned between the tabs 60. The baffle chamber may be characterized as a portion of the interior section 32 of the monocore frame 30 which is positioned between two tabs 60. When the quantity of gas is forced through the monocore frame 30 from the first end 34 to the second end 36, the quantity of gas may contact the plurality of tabs 60 which directs the gas to flow around an edge of one tab 60, e.g., a first tab along the gas discharge path, and into the baffle chamber formed between the first tab 60 and a second tab 60 along the gas discharge path. The quantity of gas flows through the port 70 formed by an overlap of the first tab 60 with a cutout section 42 in the monocore frame 30. Additionally, flexing the tabs 60 towards the central axis 40 of the monocore frame 30 upon contact with the gas may result in contact between an interior surface of the monocore frame 30 and the top perimeter edge 66 of each of the plurality of tabs 60, thereby sealing off a gas flow around the top perimeter edge 66. This varying baffle permeability and dynamic baffle chamber volume act to reduce the occurrence of resonant standing waves that may be created within the monocore frame 30 and shell 50.

Figure 9:
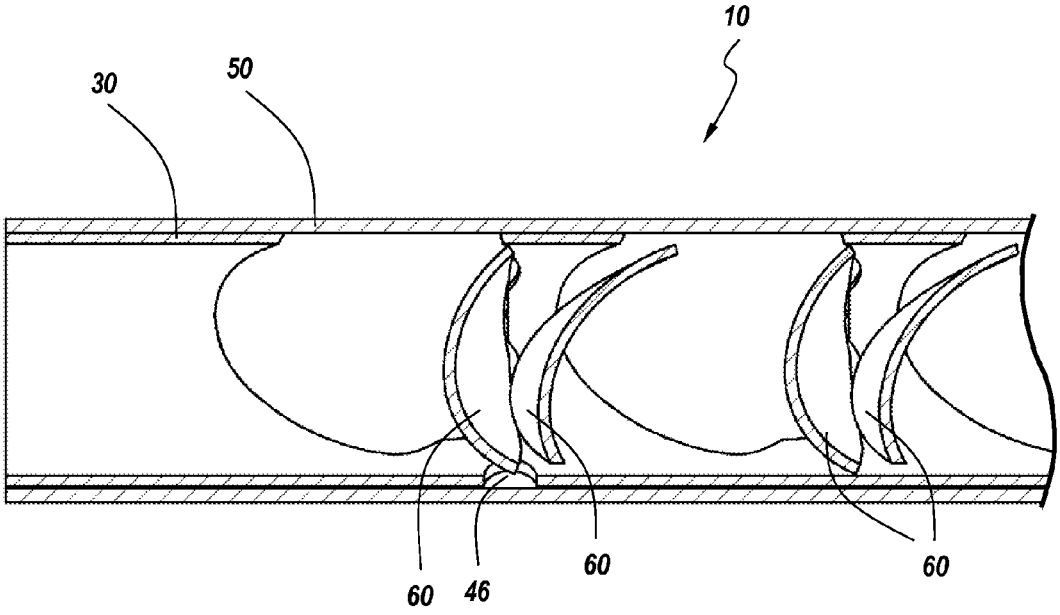
FIG. 9 is a cross-sectional view illustration of a monocore baffle apparatus with the tabs in an un-flexed state, in accordance with the first exemplary embodiment of the present disclosure.

FIG. 9 is a cross-sectional view illustration of a monocore baffle apparatus 10 with the tabs 60 in an un-flexed state, in accordance with the first exemplary embodiment of the present disclosure. A perimeter edge of a tab 60 is located in proximity to a secondary cutout section 46 in the monocore frame 30, with part of the secondary cutout section 46 being located substantially in front of the tab 60, and part of the secondary cutout section 46 being located substantially behind the tab 60. Such relative placement of the tab 60 and the secondary cutout section 46 allows exhaust gas to pass from the front of the tab 60, around the perimeter edge of the tab 60, into the space created by the secondary cutout section 46. Since the shell 50 covers the secondary cutout section 46 on the exterior of the monocore frame 30, the exhaust gas is directed into the space behind the tab 60. This action may serve to alter the rate at which, or the turbulence with which exhaust gas fills each baffle chamber, without changing the shape, size, or orientation of the tab 60 or the continuous bore aperture 68.

Figure 10:
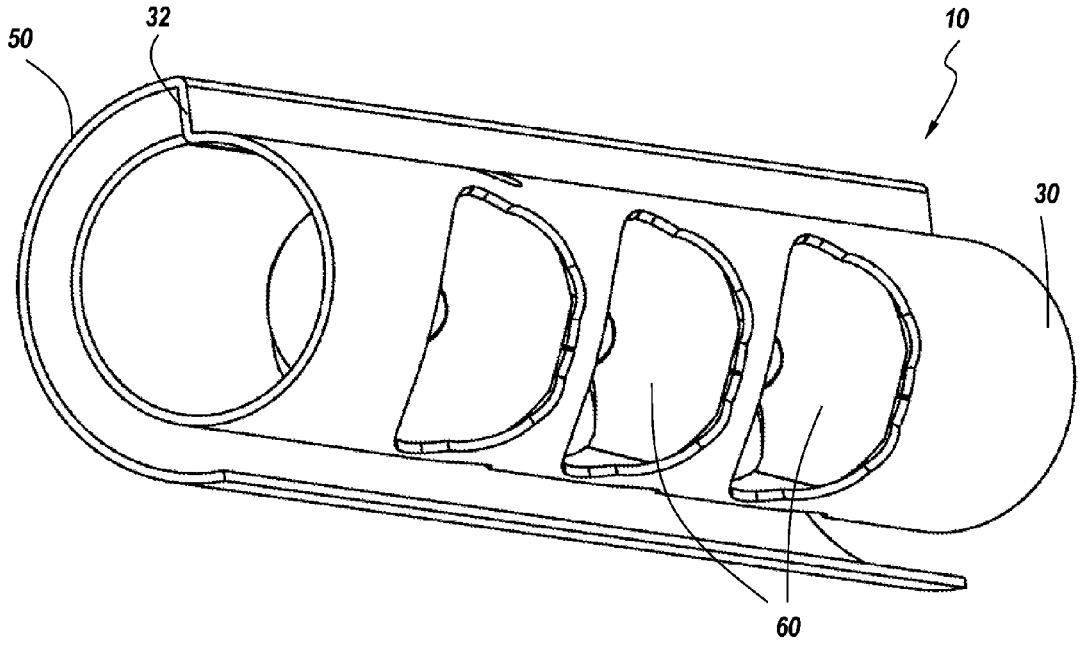
FIG. 10 is a partial cross-sectional view illustration of a monocore baffle apparatus with unitary construction, in accordance with the first exemplary embodiment of the present disclosure.

FIG. 10 is a partial cross-sectional view illustration of a monocore baffle apparatus 10 with unitary construction, in accordance with the first exemplary embodiment of the present disclosure. While the shell 50 and the monocore frame 30 may be constructed independently and separately, they may also be constructed from a single, unitary substantially planar sheet of material. Constructing the monocore frame 30 and shell 50 from a single, unitary sheet of metal, may offer significant manufacturing cost advantages over multi-piece construction. When formed from a single, unitary sheet of metal, the tabs 60 may be stamped, cut, or otherwise formed within a first area of the sheet. Then, the first area may be rolled to create the monocore frame 30, the tabs 60 of which may be bent into the interior section 32 prior to, during, or after rolling. After the tubular monocore frame 30 is formed, the remaining portion of the sheet of metal may be rolled around the exterior of the monocore frame 30 to create the shell 50. To connect the shell 50 to the monocore frame 30, a spacer rib 52 may be connected between the monocore frame 30 and the shell 50. The spacer rib 52 may secure the shell 50 in a substantially stationary position relative to the monocore frame 30 and may also space the shell 50 a distance away from the monocore frame 30. The spacer rib 52 may connect to the monocore frame 30 along the entire length of the monocore frame 30. The additional space between the monocore frame 30 and the shell 50 creates a larger volume for exhaust gas to expand into, and provides an additional chamber for pressure waves to attenuate within. The spacer rib 52 may be used to position the monocore frame 30 relative to the shell 50 without the use of secondary spacers or end caps.

Figure 11:
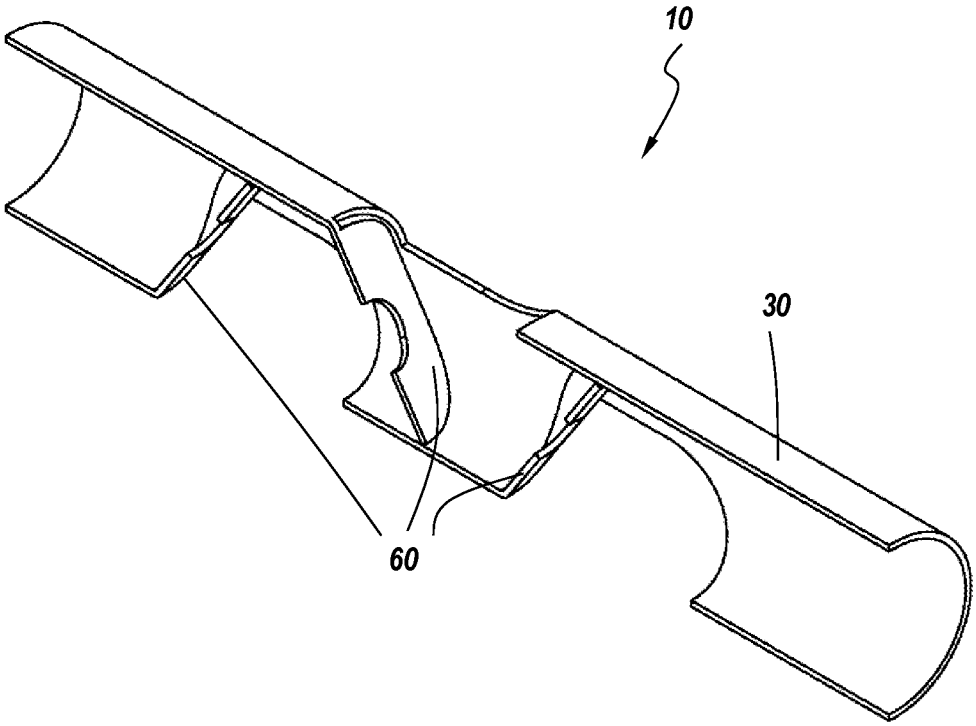
FIG. 11 is a cross-sectional view illustration of a monocore baffle apparatus having spaced tabs, in accordance with the first exemplary embodiment of the present disclosure.

FIG. 11 is a cross-sectional view illustration of a monocore baffle apparatus 10 having spaced tabs 60, in accordance with the first exemplary embodiment of the present disclosure. In particular, FIG. 11 depicts the apparatus 10 as having fewer tabs 60 than shown in FIGS. 1-10, such that the tabs 60 are spaced further apart from one another and are axially opposing. This design may be used with devices that require larger baffle chamber sizes due to the frequency of exhaust gas sound. This design may offer more simplicity in manufacturing than complex apparatus 10 designs.

Figure 12A:
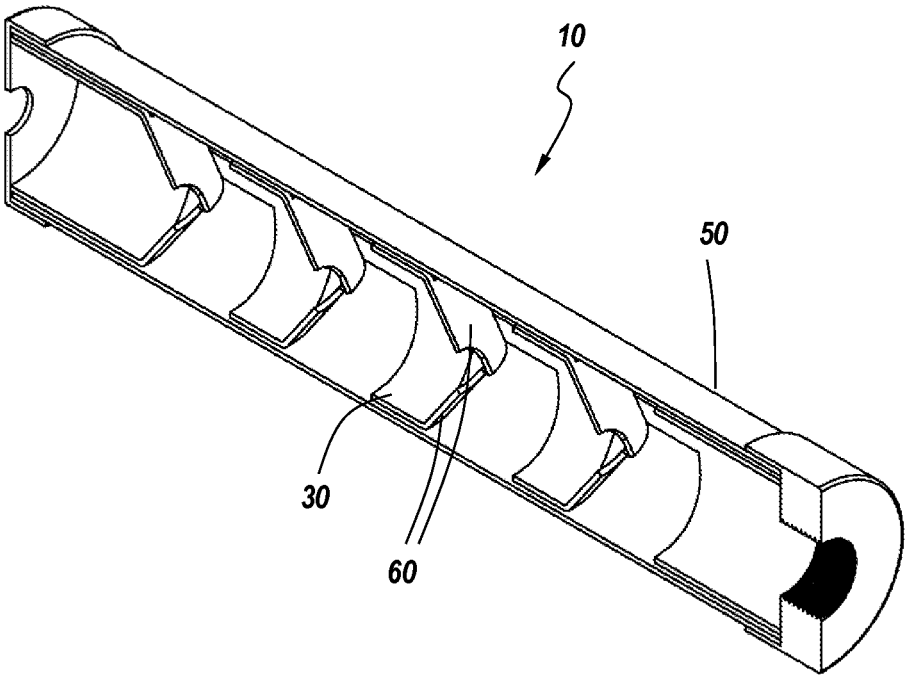
FIGS. 12A-12B are illustrations of a monocore baffle apparatus, in accordance with the first exemplary embodiment of the present disclosure.
Figure 12B:
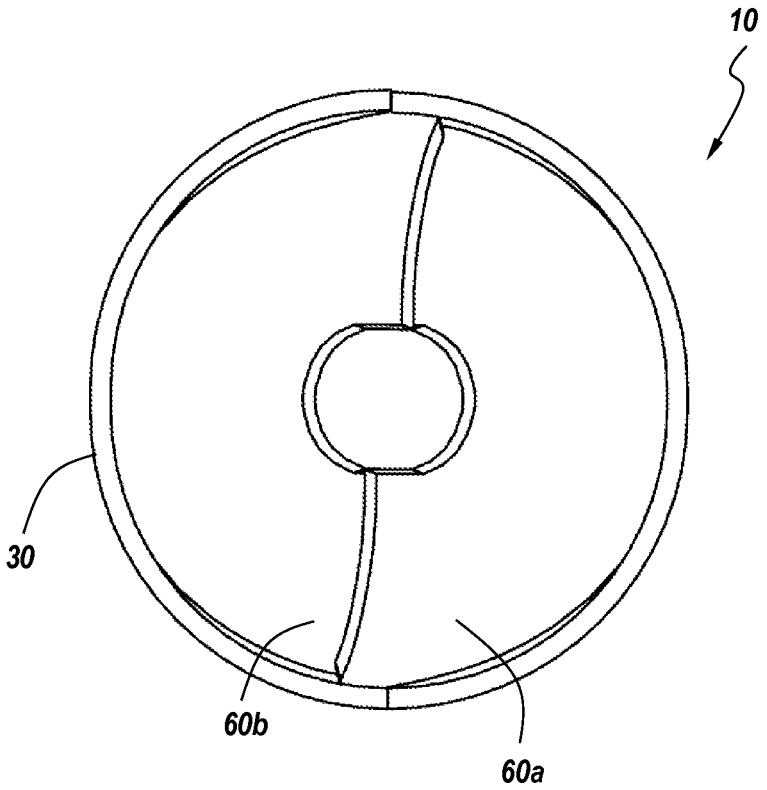

FIGS. 12A-12B are illustrations of a monocore baffle apparatus 10, in accordance with the first exemplary embodiment of the present disclosure. As is shown, the apparatus 10 may include tabs 60 positioned substantially in opposition with one another, such that when the tabs 60 are bent inwards, they contact one another. In this design, a first tab 60 may be in contact with an opposing second tab 60. The contact between the tabs 60 may include moving contact therebetween, in that, when the tabs 60 are flexed, they may remain in contact during flexing. In some situations, the first tab 60 may be interlocked with the second tab 60, such that the two tabs 60 have an interlocking connection formed therebetween. The interlocking connection, best shown in FIG. 12B, may be achieved by each of the first tab 60*a* and the second tab 60*b* having a left side and a right side thereof. The left side of the first tab 60*a* may connect with or be positioned over the right side of the second tab 60*b*, and the right side of the first tab 60*a* may connect with or be positioned over the left side of the second tab 60*b*. As one skilled in the art can understand, the contact between opposing sides in this fashion may allow the tabs 60 to interlock. The overlap of the tabs 60 may create channels for flowing gas to move past the tabs 60, and imparts a swirling or twisting effect on the flow of the gas.

Figure 13:
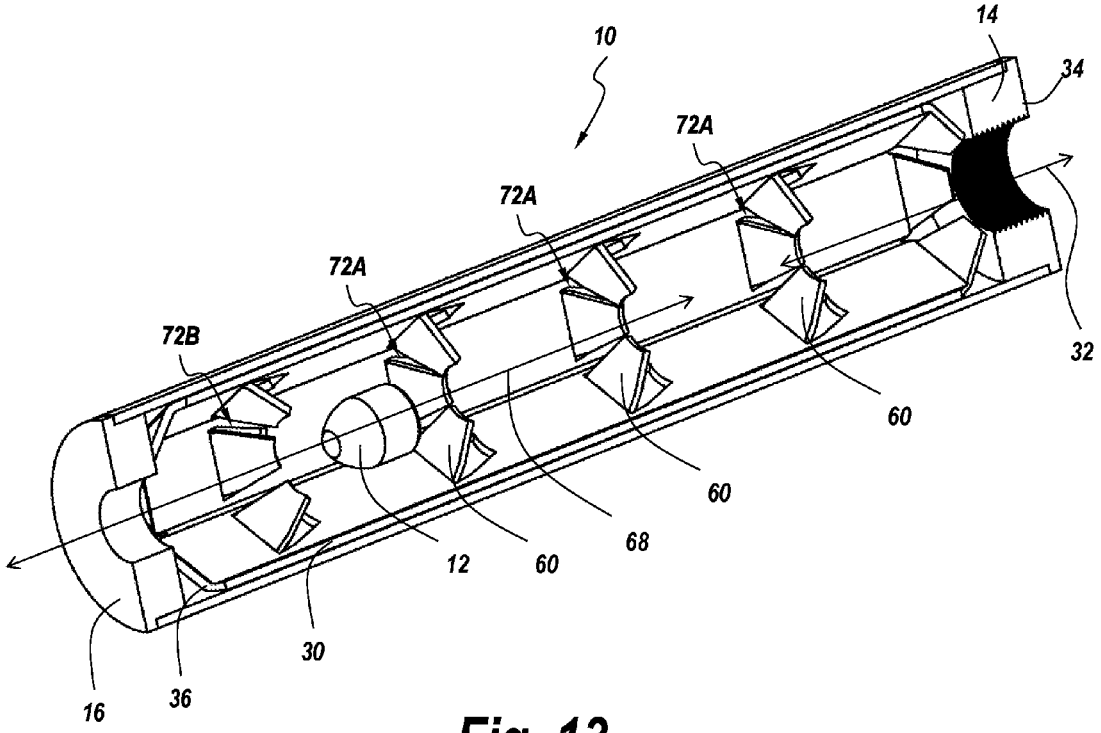
FIG. 13 is a cross-sectional illustration of a monocore baffle apparatus, in accordance with the first exemplary embodiment of the present disclosure.

FIG. 13 is a cross-sectional illustration of a monocore baffle apparatus 10, in accordance with the first exemplary embodiment of the present disclosure. The apparatus 10 is shown with the shell 50 positioned around the monocore frame 30 and with end caps 14, 16 connected to the ends of the shell 50. A projectile 12 is shown within the continuous bore aperture 68 formed interior of the tabs 60. The tabs 60 may be formed as substantially planar structures which extend angularly towards the interior of the monocore frame 30. The tabs 60 may be positioned along many radial points of the monocore frame 30, such as in six different radial points. In this design, tabs 60 may be positioned in direct opposition with one another across the monocore frame 30. The use of the apparatus 10 of FIG. 13 is substantially similar to that discussed previously, in that, after the projectile 12 moves along the continuous bore aperture 68 and past a set of tabs 60, the discharged gas behind the projectile 12 will contact the set of tabs 60 and flex them. It can be seen in FIG. 13 that the three sets of tabs 60 already passed by the projectile 12 are flexed, such that the relative distances (indicated by 72A) between each tab 60 of each individual set that is flexed, is less than the relative distance (indicated by 72B) for the un-flexed set of tabs 60, e.g., the remaining set that the projectile 12 has not moved past yet.

Figure 14:
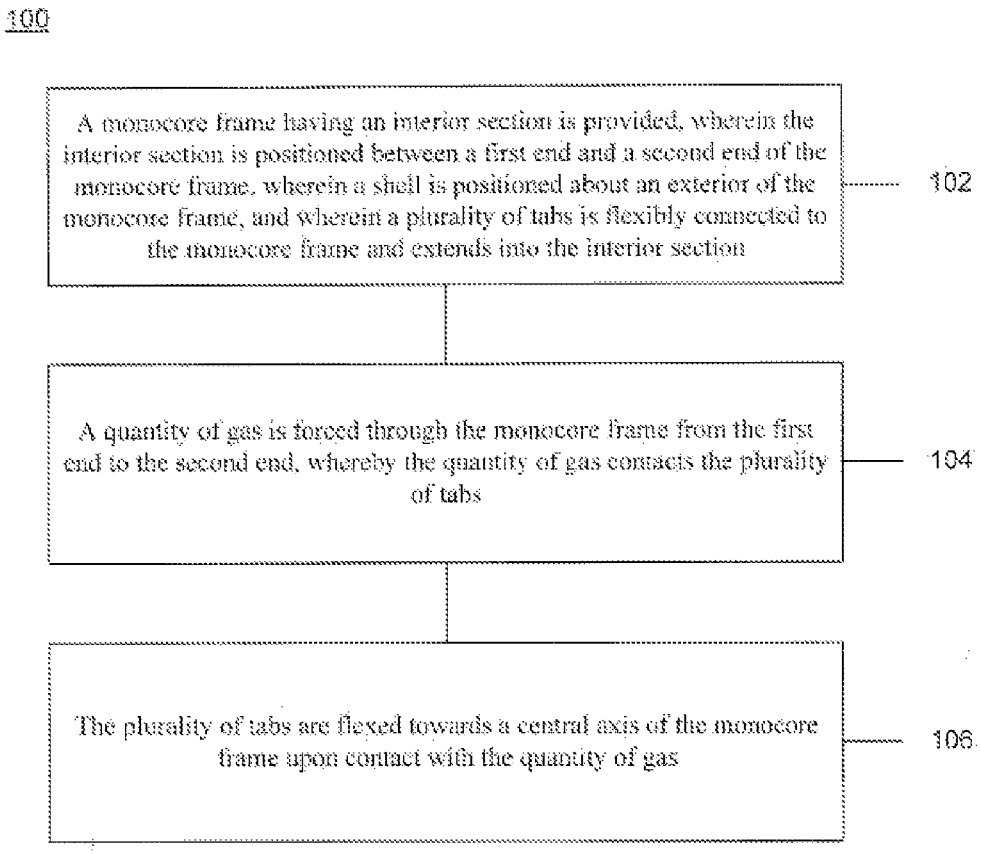
FIG. 14 is a flowchart illustrating a method for muffling sound using a monocore baffle apparatus, in accordance with the first exemplary embodiment of the disclosure.

FIG. 14 is a flowchart 100 illustrating a method for muffling sound using a monocore baffle apparatus 10, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a monocore frame having an interior section is provided, wherein the interior section is positioned between a first end and a second end of the monocore frame, wherein a shell is positioned about an exterior of the monocore frame, and wherein a plurality of tabs is flexibly connected to the monocore frame and extends into the interior section. A quantity of gas is forced through the monocore frame from the first end to the second end, whereby the quantity of gas contacts the plurality of tabs (block 104). The plurality of tabs are flexed towards a central axis of the monocore frame upon contact with the quantity of gas (block 106).

The method may include a variety of additional steps, processes, functions, or features, including any of those disclosed herein. For example, flexing the plurality of tabs towards the central axis of the monocore frame may include altering a continuous bore aperture positioned between the plurality of tabs and changing a volume of a baffle chamber positioned between the plurality of tabs. Altering the continuous bore aperture may include at least one of: decreasing a cross-sectional area of the continuous bore aperture; and repositioning an axis of the continuous bore aperture relative to the central axis. The continuous bore aperture may be substantially linear in a non-flexed state of the plurality of tabs and may be substantially non-linear in a flexed state of the plurality of tabs.

When a projectile is fired through the continuous bore aperture, the quantity of gas may be forced through the monocore frame from the first end to the second end, wherein a cross section of the continuous bore aperture in the non-flexed state of the plurality of tabs is sized larger than the cross section of the continuous bore aperture in the flexed state of the plurality of tabs. Forcing the quantity of gas through the monocore frame from the first end to the second end will include directing the quantity of gas to flow around an edge of a first tab of the plurality of tabs and into a chamber formed between the first tab and a second tab, wherein the quantity flows through a port formed by an overlap of the first tab with a cutout section in the monocore frame. Flexing the plurality of tabs towards the central axis of the monocore frame upon contact with the quantity of gas may include changing a size of the port formed by the overlap of the first tab with the cutout section of the second tab. Additionally, flexing the plurality of tabs towards the central axis of the monocore frame upon contact with the quantity of gas may include contacting an interior surface of the monocore frame with a top perimeter edge of each of the plurality of tabs, thereby sealing off a gas flow around the top perimeter edge.

Figure 15:
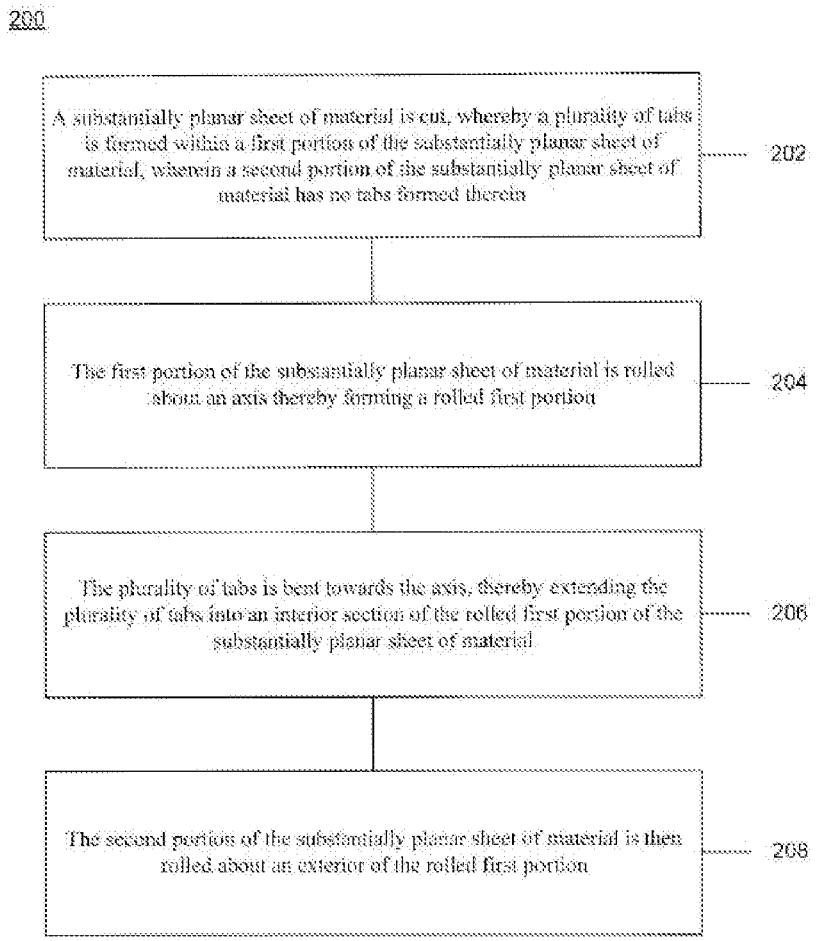
FIG. 15 is a flowchart illustrating a method of manufacturing a monocore baffle apparatus, in accordance with the first exemplary embodiment of the disclosure.

FIG. 15 is a flowchart 200 illustrating a method of manufacturing a monocore baffle apparatus 10, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a substantially planar sheet of material is cut, whereby a plurality of tabs is formed within a first portion of the substantially planar sheet of material, wherein a second portion of the substantially planar sheet of material has no tabs formed therein. The first portion of the substantially planar sheet of material is rolled about an axis thereby forming a rolled first portion (block 204). The plurality of tabs is bent towards the axis, thereby extending the plurality of tabs into an interior section of the rolled first portion of the substantially planar sheet of material (block 206). The second portion of the substantially planar sheet of material is then rolled about an exterior of the rolled first portion (block 208). The method may include a variety of additional steps, processes, functions, or features, including any of those disclosed herein. Optionally, cutting a substantially planar sheet of material to form the plurality of tabs may include forming a continuous bore aperture feature through all of the plurality of tabs.

Figure 16A:
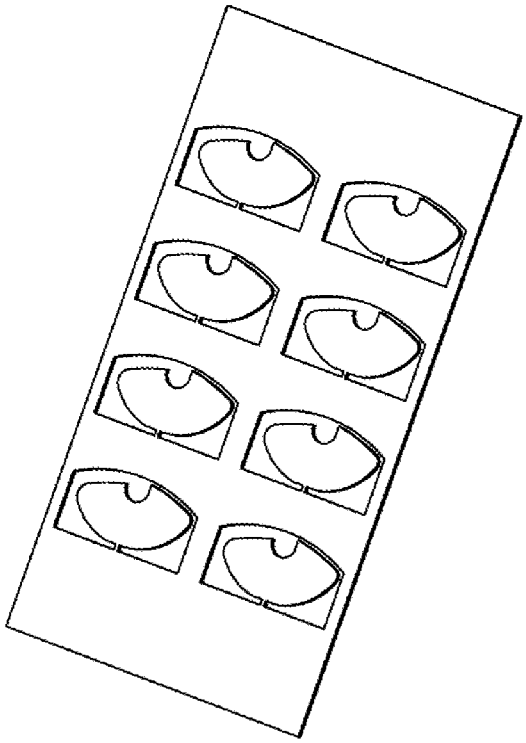
FIGS. 16A-16C are various illustrations of a monocore baffle apparatus during a method of construction thereof, in accordance with the first exemplary embodiment of the present disclosure.
Figure 16B:
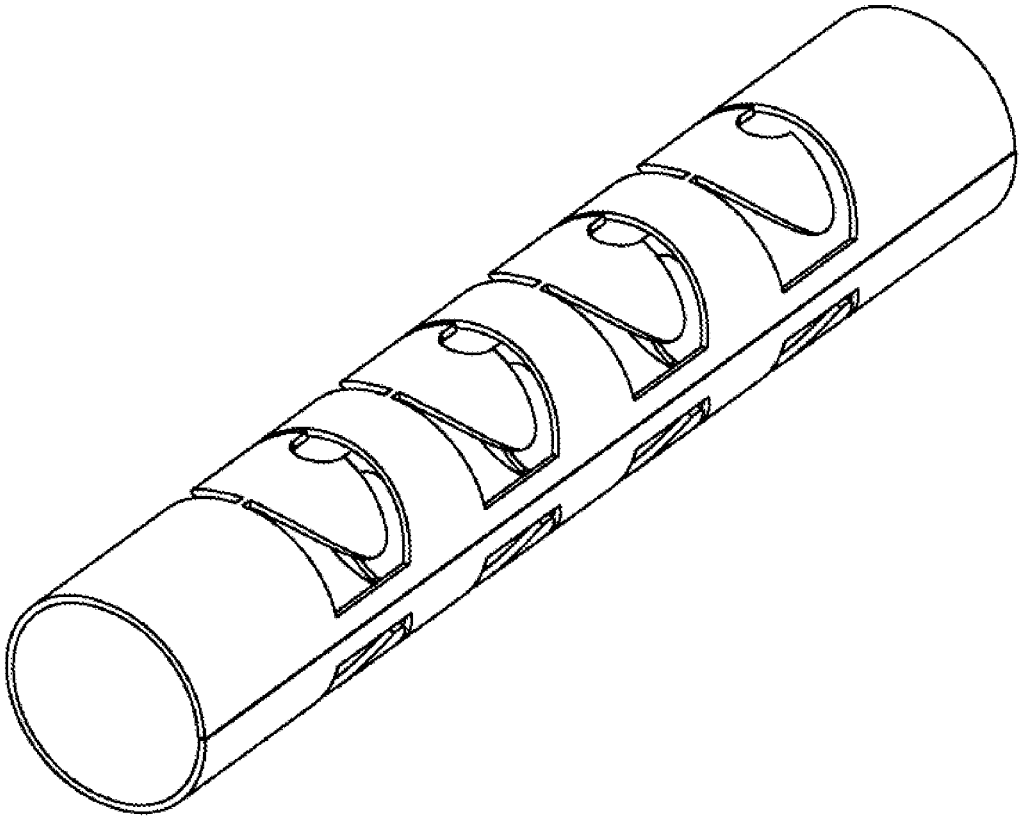
Figure 16C:
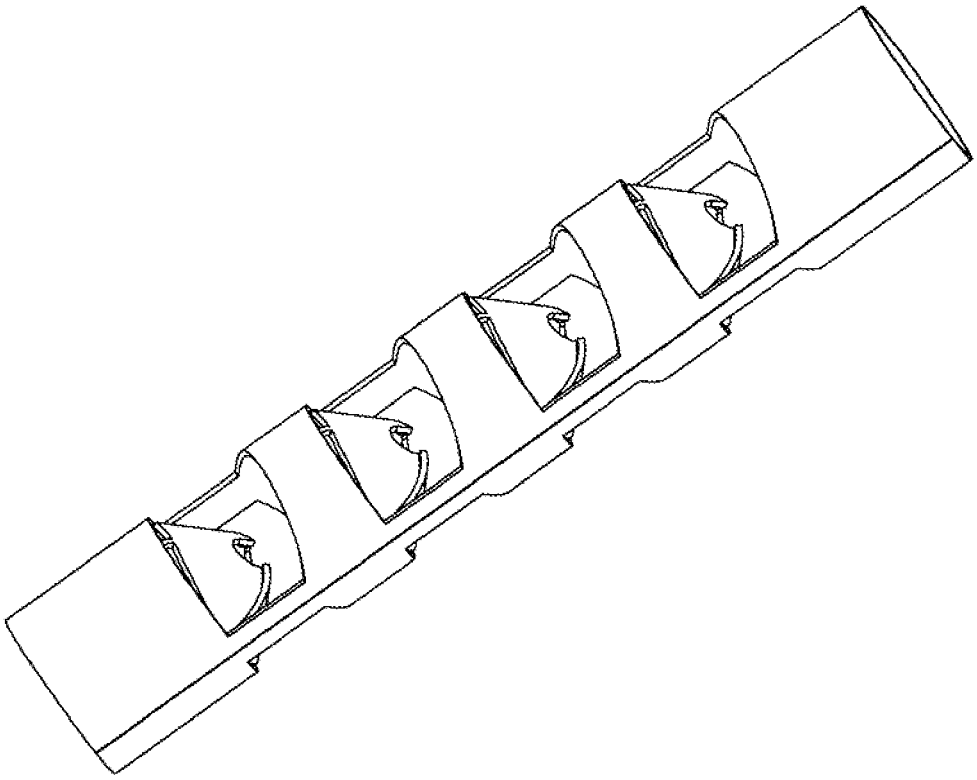

FIGS. 16A-16C are various illustrations of a monocore baffle apparatus during a method of construction thereof, in accordance with the first exemplary embodiment of the present disclosure. The monocore frame and plurality of tabs may be formed from a variety of processes and techniques. For example, the plurality of tabs may be formed out of one flat sheet of metal by cutting the tabs from the sheet of metal and then rolling the sheet. As is shown in FIG. 16A, a flat sheet of metal is provided with tab features cutout therein. The tab features may have a semi-circular cross section when the sheet is rolled into a tube, as is shown in FIG. 16B, and the tabs are bent inwards towards a central axis of the tube at a specific angle, as is shown in FIG. 16C. The tabs may contact one another or interlock with one another. The finished monocore frame with tabs, ready for insertion into a shell (not depicted) is depicted in FIG. 16C.

Figure 17A:
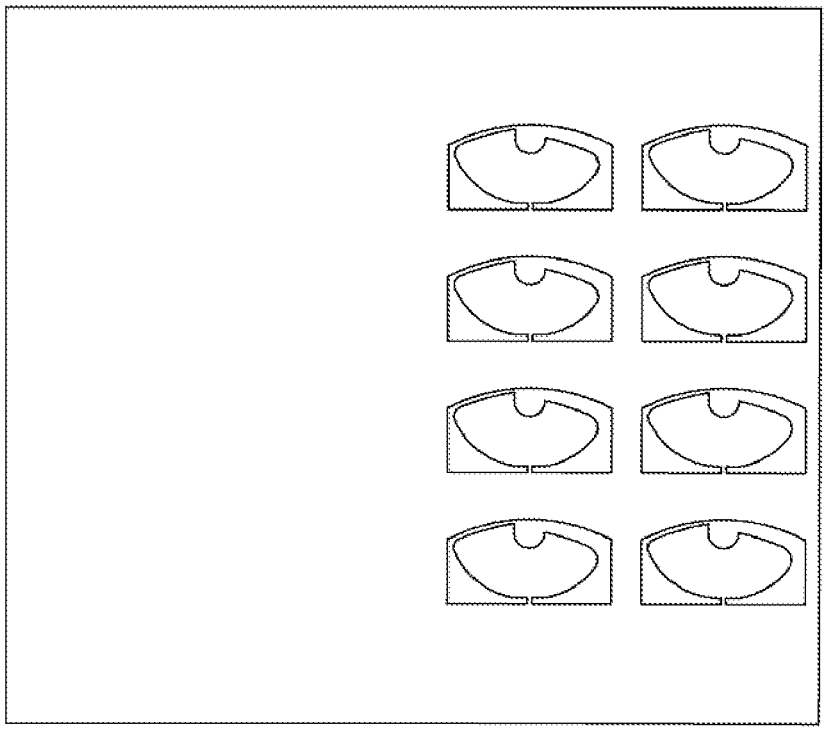
FIGS. 17A-17C are various illustrations of a monocore baffle apparatus during a method of construction thereof, in accordance with the first exemplary embodiment of the present disclosure.
Figure 17B:
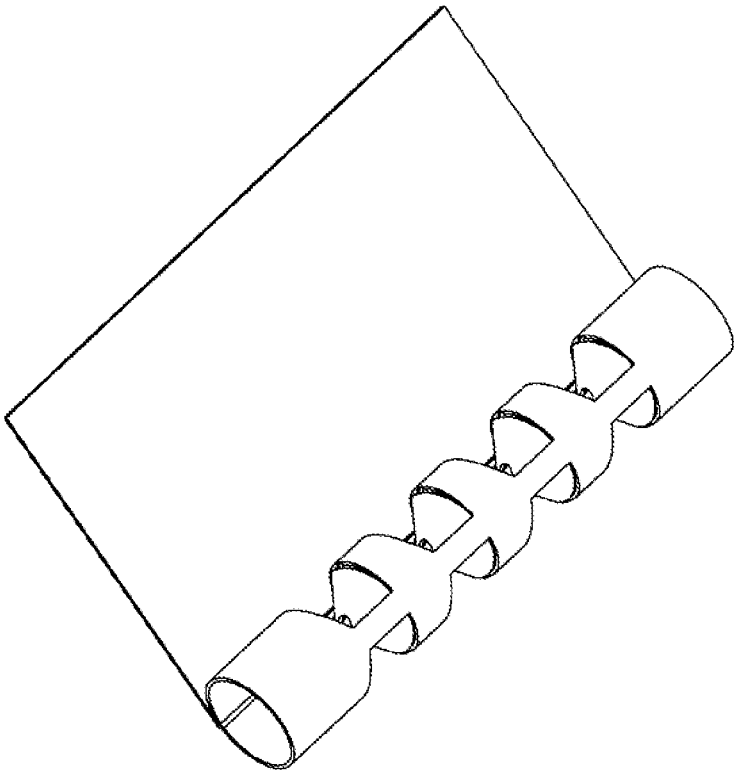
Figure 17C:
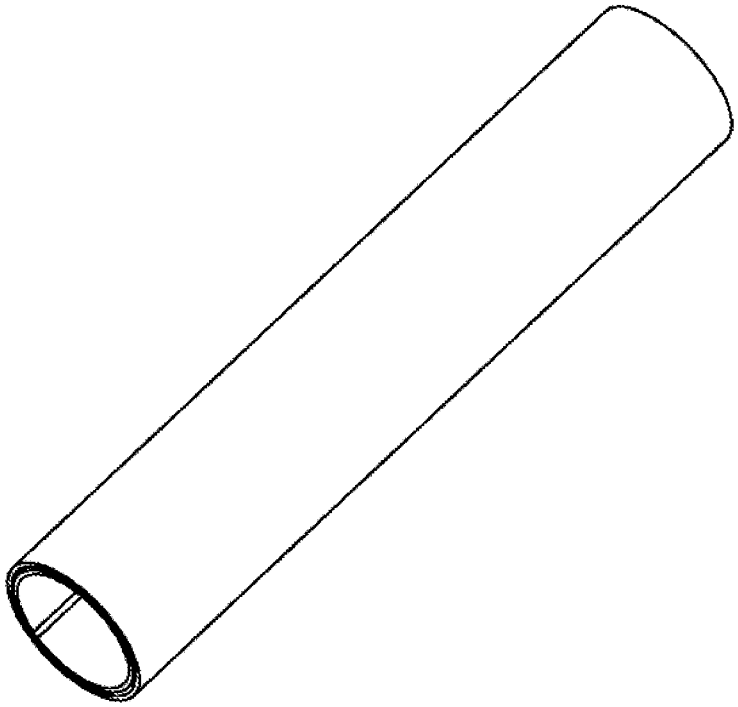

FIGS. 17A-17C are various illustrations of a monocore baffle apparatus during a method of construction thereof, in accordance with the first exemplary embodiment of the present disclosure. In FIGS. 17A-17C, the entirety of the monocore baffle apparatus may be formed from a single, unitary sheet of material. As is shown in FIG. 17A, a flat sheet of metal is provided with tab features cutout therein. The tab features may have a semi-circular cross section when the sheet is rolled into a tube, as is shown in FIG. 17B, and the tabs are bent inwards towards a central axis of the tube at a specific angle, also as is shown in FIG. 17B. Next, the remaining portion of the unitary sheet of material is then rolled around the monocore frame to achieve the monocore baffle device, depicted in FIG. 17C. As mentioned previously, the monocore frame and shell being constructed from a single, unitary sheet of metal may offer significant manufacturing cost advantages over multi-piece construction.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A monocore baffle apparatus comprising:

a monocore frame having an interior section, wherein the interior section is positioned between a first end and a second end of the monocore frame;

a shell positioned about an exterior of the monocore frame; and a plurality of tabs connected to the monocore frame and extending into the interior section, wherein at least a portion of the plurality of tabs is flexibly connected to the monocore frame, and wherein the monocore frame and shell are formed from a single, unitary substantially planar sheet of material.

2. The monocore baffle apparatus of claim 1, wherein each of the plurality of tabs have an aperture edge, wherein each of the aperture edges defines a continuous bore aperture through the monocore frame between the first and second end thereof, wherein a projectile is movable through the continuous bore aperture.

3. The monocore baffle apparatus of claim 2, wherein the continuous bore aperture further comprises a dynamically-sized aperture, wherein a size of the dynamically-sized aperture is controlled by a flexing of the plurality of tabs relative to the monocore frame.

4. The monocore baffle apparatus of claim 3, wherein a flexing of the plurality of tabs relative to the monocore frame is controlled by a quantity of gas moving through the monocore frame and contacting the plurality of tabs.

5. The monocore baffle apparatus of claim 2, wherein the aperture edge of a first of the plurality of tabs is aligned with the aperture edge of a second of the plurality of tabs.

6. The monocore baffle apparatus of claim 1, wherein the plurality of tabs further comprise at least a first tab extending from a first radial area of the monocore frame and a second tab extending from a second radial area of the monocore frame, wherein the first radial area is different from the second radial area.

7. The monocore baffle apparatus of claim 6, wherein the first tab is in contact with the second tab.

8. The monocore baffle apparatus of claim 6, wherein the monocore frame further comprises a central axis positioned parallel with a length of the monocore frame, wherein the first radial area of the monocore frame is non-axially-opposing the second radial area of the monocore frame about the central axis.

9. The monocore baffle apparatus of claim 6, wherein the first tab is interlocked with the second tab.

10. The monocore baffle apparatus of claim 9, wherein each of the first and second tabs further comprises a left side and a right side, wherein the first tab is interlocked with the second tab through contact between the left and right sides of each of the first and second tabs.

11. The monocore baffle apparatus of claim 1, wherein at least a portion of the plurality of tabs further comprises a non-planar shape.

12. The monocore baffle apparatus of claim 11, wherein the non-planar shape further comprises a partial cone shape.

13. The monocore baffle apparatus of claim 1, further comprising a vein positioned in a sidewall of the monocore frame.

14. The monocore baffle apparatus of claim 2, wherein the monocore frame is flexible about the central axis.

15. The monocore baffle apparatus of claim 1, further comprising a spacer rib connected between the monocore frame and the shell, wherein the spacer rib spaces the shell a distance from the monocore frame.

16. A method of manufacturing a monocore baffle apparatus comprising:

cutting a substantially planar sheet of material, whereby a plurality of tabs are formed within a first portion of the substantially planar sheet of material, wherein a second portion of the substantially planar sheet of material has no tabs formed therein;

rolling the first portion of the substantially planar sheet of material about an axis thereby forming a rolled first portion;

bending the plurality of tabs towards the axis, thereby extending the plurality of tabs into an interior section of the rolled first portion of the substantially planar sheet of material; and rolling the second portion of the substantially planar sheet of material about an exterior of the rolled first portion.

17. The method of claim 16, wherein the step of cutting a substantially planar sheet of material to form the plurality of tabs further comprises forming a continuous bore aperture feature through all of the plurality of tabs.

18. A method for muffling sound using a monocore baffle apparatus, the method comprising the steps of:

providing a monocore frame having an interior section, wherein the interior section is positioned between a first end and a second end of the monocore frame, wherein a shell is positioned about an exterior of the monocore frame, and wherein a plurality of tabs is flexibly connected to the monocore frame and extends into the interior section;

forcing a quantity of gas through the monocore frame from the first end to the second end, whereby the quantity of gas contacts the plurality of tabs; and flexing the plurality of tabs towards a central axis of the monocore frame upon contact with the quantity of gas, thereby altering a continuous bore aperture positioned between the plurality of tabs and changing a volume of a baffle chamber positioned between the plurality of tabs, wherein the continuous bore aperture is substantially linear in a non-flexed state of the plurality of tabs and is substantially non-linear in a flexed state of the plurality of tabs.

19. The method of claim 18, wherein altering the continuous bore aperture further comprises at least one of:

decreasing a cross-sectional area of the continuous bore aperture; and re-positioning an axis of the continuous bore aperture relative to the central axis.

20. The method of claim 18, further comprising interlocking at least two of the plurality of tabs together about the continuous bore aperture.

21. The method of claim 18, further comprising firing a projectile through the continuous bore aperture, thereby forcing the quantity of gas through the monocore frame from the first end to the second end, wherein a cross section of the continuous bore aperture in the non-flexed state of the plurality of tabs is sized larger than the cross section of the continuous bore aperture in the flexed state of the plurality of tabs.

22. The method of claim 18, wherein the plurality of tabs have curvilinear shape, the curvilinear shape being positioned about a tab axis, further comprising flexing the plurality of tabs about the tab axis when the quantity of gas contacts the plurality of tabs.

23. The method of claim 18, further comprising flexing the monocore frame about the central axis to decrease a cross-sectional diameter of the monocore frame during a removal of the monocore frame from the shell.

24. The method of claim 18, wherein the step of forcing the quantity of gas through the monocore frame from the first end to the second end, whereby the quantity of gas contacts the plurality of tabs, further comprises directing the quantity of gas to flow around an edge of a first tab of the plurality of tabs and into a chamber formed between the first tab and a second tab, wherein the quantity of gas flows through a port formed by an overlap of the first tab with a cutout section in the monocore frame.

25. The method of claim 24, wherein flexing the plurality of tabs towards the central axis of the monocore frame upon contact with the quantity of gas further comprises changing a size of the port formed by the overlap of the first tab with the cutout section of the second tab.

26. The method of claim 24, wherein the port with the first tab in an un-flexed state is a different size than the port with the first tab in a flexed state.

27. The method of claim 24, wherein the step of flexing the plurality of tabs towards the central axis of the monocore frame upon contact with the quantity of gas further comprises contacting an interior surface of the monocore frame with a top perimeter edge of each of the plurality of tabs, thereby sealing off a gas flow around the top perimeter edge.

* * * * *